US009883694B2

(12) United States Patent
Almsberger et al.

(10) Patent No.: US 9,883,694 B2
(45) Date of Patent: Feb. 6, 2018

(54) CIGAR CUTTER

(71) Applicant: Xikar, Inc., Kansas City, MO (US)

(72) Inventors: Scott Almsberger, Tonganoxie, KS (US); Robert Lembke, Overland Park, KS (US); Greg Lorett, Kansas City, MO (US); Kurt Van Keppel, Leawood, KS (US)

(73) Assignee: XIKAR, INC., Kansas City, MO (US)

( * ) Notice: Subject to any disclaimer, the term of this patent is extended or adjusted under 35 U.S.C. 154(b) by 93 days.

(21) Appl. No.: 15/046,030

(22) Filed: Feb. 17, 2016

(65) Prior Publication Data

US 2017/0231271 A1 Aug. 17, 2017

(51) Int. Cl.
*A24F 13/26* (2006.01)
*A24F 13/24* (2006.01)

(52) U.S. Cl.
CPC ..... *A24F 13/26* (2013.01); *A24F 13/24* (2013.01)

(58) Field of Classification Search
CPC ..... A24F 13/26; A24F 13/24; A24C 1/24
See application file for complete search history.

(56) References Cited

U.S. PATENT DOCUMENTS

| | | | | |
|---|---|---|---|---|
| 1,269,593 | A | 6/1918 | Fuller | |
| 1,294,479 | A | 2/1919 | Kollmar | |
| D410,109 | S | 5/1999 | Van Keppel et al. | |
| 5,937,523 | A | 8/1999 | Van Keppel et al. | |
| 6,076,260 | A | 6/2000 | Williamson, IV | |
| 6,164,286 | A | 12/2000 | Schad | |
| 6,708,409 | B2 | 3/2004 | Yu | |
| 8,656,595 | B2 | 2/2014 | Wong | |
| 2003/0188433 | A1* | 10/2003 | Yu | A24F 13/26 30/113 |
| 2007/0089299 | A1 | 4/2007 | Belaubre | |
| 2007/0283568 | A1* | 12/2007 | Chen | B26D 3/16 30/92 |
| 2010/0162569 | A1 | 7/2010 | Smith | |

FOREIGN PATENT DOCUMENTS

DE 19949510 C1 6/2001

OTHER PUBLICATIONS

Cigarone web page: https://www.cigarone.com/news.php?deb=284.
Cigarworld web page: http://www.cigarworld.de/zigarrenzubehoer/cutter/wolfertz-cts-xeto-80000237.
Danpipe web page: http://www.danpipe.de/de/5001-3801_XETO-Cigar-Cutter-matt-silberfarben-Eichenholz-inkl-Etui-Sonderangebot_9851?action_ms=1.

* cited by examiner

*Primary Examiner* — Stephen Choi
(74) *Attorney, Agent, or Firm* — Erickson Kernell IP, LLC

(57) ABSTRACT

A guillotine-style cigar cutter. The cutter includes a body with a central aperture and a pair of blades disposed on opposite sides of the aperture and configured to move translationally across the aperture to cut an end of a cigar in preparation for smoking. A gear train is provided that includes a ring gear disposed to circumscribe the aperture and to engage pairs of spur gears disposed at diametrically opposite positions. Edges of the blades engage the spur gears in a rack-and-pinion style configuration. The gear train thus provides synchronous and symmetrical movements of the blades relative to one another.

19 Claims, 3 Drawing Sheets

CIGAR CUTTER

BACKGROUND

Cigars are typically manufactured, either by hand or by machine, with one end that is cut and an opposite end that is closed off to form a cap. The cap must be cut or punctured prior to smoking to allow air and smoke to be drawn through the cap end of the cigar. A variety of devices are known in the art for preparing the cap of the cigar for smoking including punches, V-cutters or notch cutters, knives, scissors, and guillotine cutters.

Exemplary guillotine cutters are described in U.S. Pat. No. 8,656,595 to Wong and U.S. Patent Publication No. 2010/0162569 to Smith. These cutters include a housing with a central aperture in which a cigar can be inserted. A pair of oppositely oriented guillotine blades are provided that intersect the aperture and are slideably movable across the aperture to engage and cut through the cigar inserted therein. Each of the blades is biased by a spring to move outwardly away from the aperture to allow insertion of the cigar therein, or the blades can be depressed toward one another and locked in a position lying across the aperture.

U.S. Patent Publication No. 2007/0089299 to Belaubre discloses a scissor-like cigar cutter device that discloses the use of cutting blades with toothed portions that cooperate with a gear wheel to enable the blades to move simultaneously and symmetrically about a middle axis. The blades are locked in the closed position using hooks. The blades are unlocked by manually separating the hooks. Once unlocked, a spring forces the blades pivotally apart to an open position.

SUMMARY

Embodiments of the invention are defined by the claims below, not this summary. A high-level overview of various aspects of the invention is provided here to introduce a selection of concepts that are further described in the Detailed-Description section below. This summary is not intended to identify key features or essential features of the claimed subject matter, nor is it intended to be used in isolation to determine the scope of the claimed subject matter. In brief, this disclosure describes, among other things, a cigar cutter.

The cigar cutter includes a torus-shaped or doughnut-shaped body with a central aperture extending therethrough and sized to receive at least an end portion of a cigar therein. A pair of oppositely oriented blade assemblies are provided and are translationally moveable between an extended position and a collapsed position. In the extended position leading edges of the blades lie outside of the aperture and in the collapsed position the leading edges of the blades are moved toward one another such that the blades overlap and fully obstruct the aperture.

A gear train is provided that maintains symmetrical movements of the blade assemblies between the extended and collapsed positions. The gear train also provides bias of the blade assemblies toward the extended position and retention of the blades in the collapsed position when a locking arm is engaged therewith.

DESCRIPTION OF THE DRAWINGS

Illustrative embodiments of the invention are described in detail below with reference to the attached drawing figures, and wherein.

DETAILED DESCRIPTION

The subject matter of select embodiments of the invention is described with specificity herein to meet statutory requirements. But the description itself is not intended to necessarily limit the scope of claims. Rather, the claimed subject matter might be embodied in other ways to include different components, steps, or combinations thereof similar to the ones described in this document, in conjunction with other present or future technologies. Terms should not be interpreted as implying any particular order among or between various steps herein disclosed unless and except when the order of individual steps is explicitly described. The terms "about" or "approximately" as used herein denote deviations from the exact value by +/−10%, preferably by +/−5% and/or deviations in the form of changes that are insignificant to the function.

With reference to FIGS. 1-5, a cigar cutter 10 is described in accordance with an embodiment of the invention. The cutter 10 is described herein as a cigar cutter but embodiments of the invention are not so limited. For example, the cutter 10 may be employed and/or configured for cutting various other objects, such as cigarettes, cigarillos, little cigars, and other tobacco and non-tobacco products.

Figure 1:
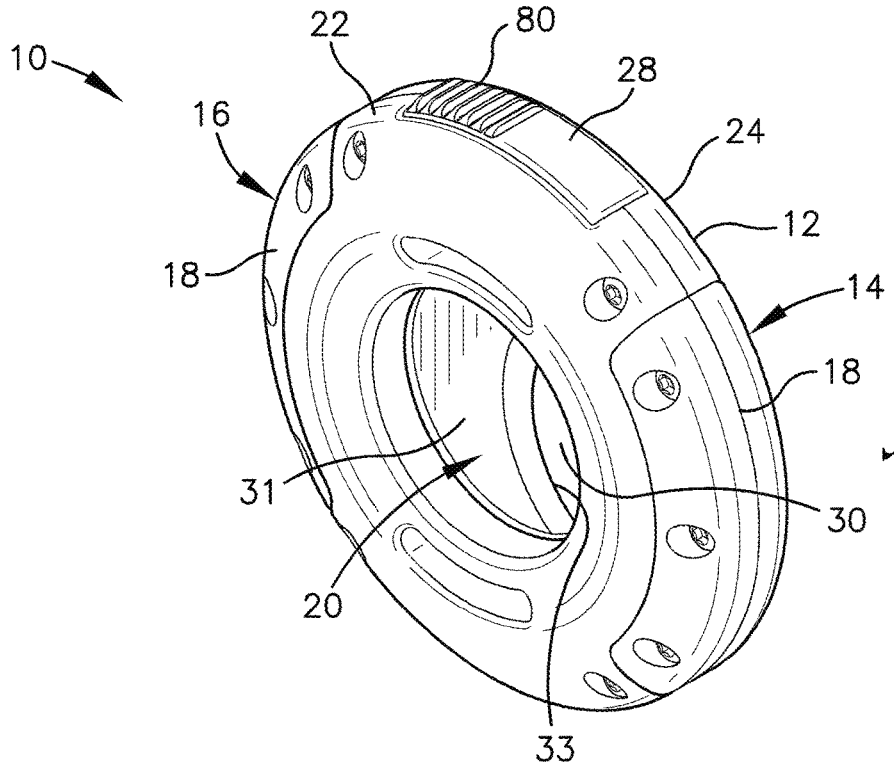
FIG. 1 is a perspective view of a cigar cutter is a closed state depicted in accordance with an embodiment of the invention.
Figure 2:
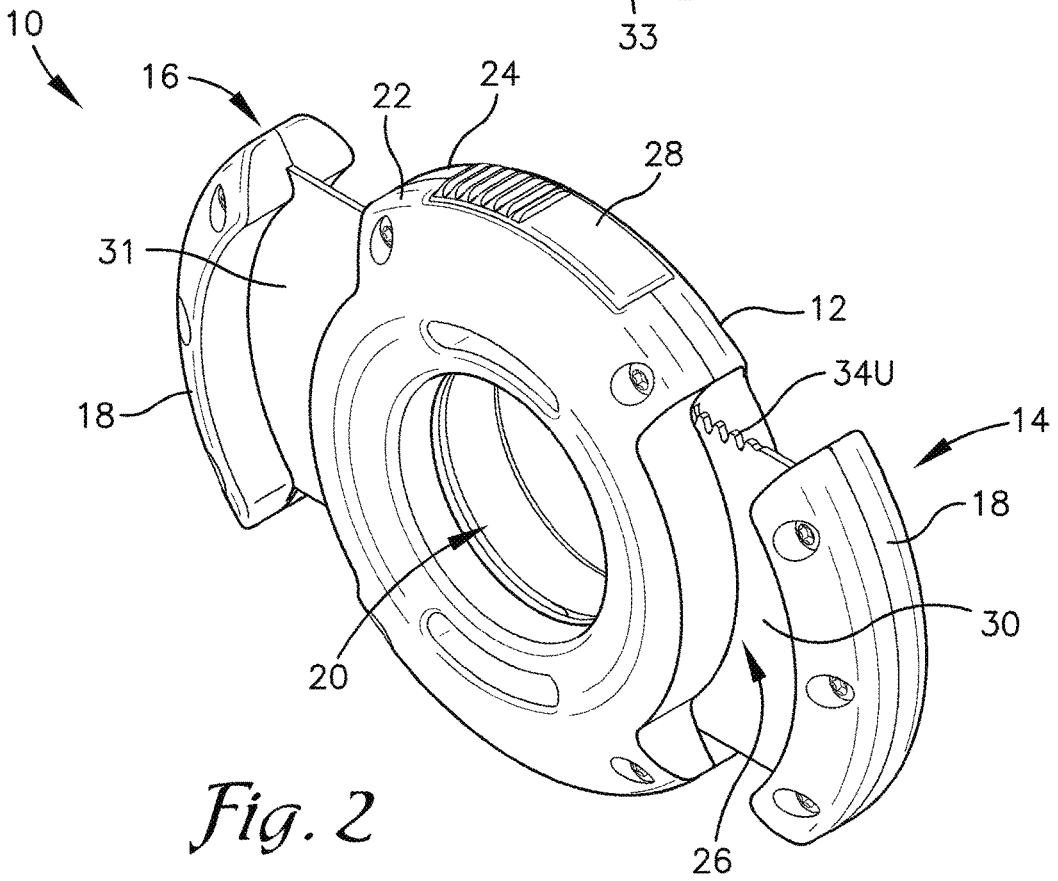
FIG. 2 is a perspective view of the cigar cutter of FIG. 1 in an open state depicted in accordance with an embodiment of the invention.

The cutter 10 includes a body 12, a first and second blade assembly 14, 16 that are translationally moveable between a collapsed position shown in FIG. 1 and an extended position shown in FIG. 2. In the collapsed position, the body 12 and handle portions 18 of the blade assemblies 14, 16 form a ring torus or doughnut shape with an aperture 20 extending coaxially therethrough. The cutter 10 can take other overall forms that include the aperture 20 extending therethrough, e.g. non-torus forms.

The body 12 comprises a front plate 22 and a back plate 24 that when coupled together form a slot 26 extending through a central portion of the body 12 across the width of the body 12, e.g. along a diameter of the body, and perpendicular to the central axis of the aperture 20. The front and back plates 22, 24 also form an opening in which a latch lever 28 is disposed as described more fully below.

Figure 5:
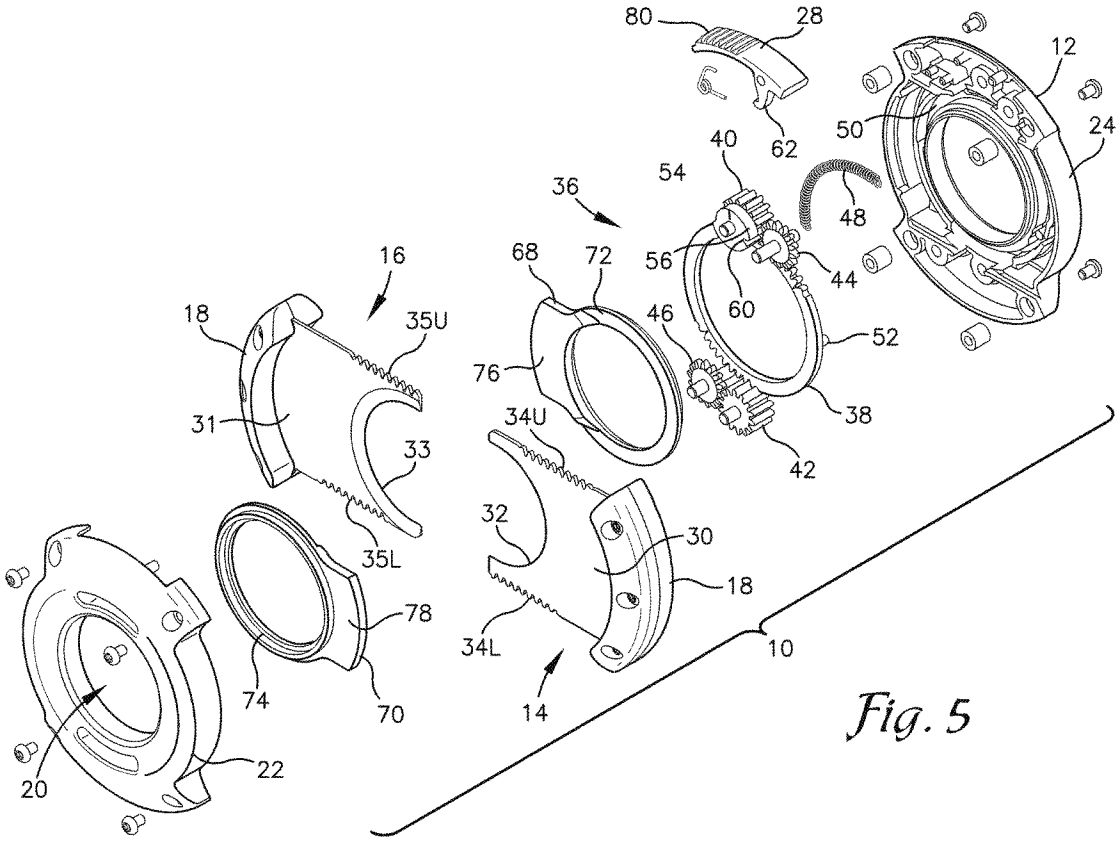
FIG. 5 is an exploded view of the cigar cutter of FIG. 1.

As best shown in FIG. 5, the blade assemblies 14, 16 each include a blade 30, 31 respectively, with the handle portions 18 coupled to a first ends thereof. The handle portions 18 are coupled to the blades 30, 31, such as by fasteners, adhesives, welding or the like, and preferably have a form that compliments or completes the overall torus shape of the body 12 when in the collapsed position. However, the handle portions 18 may take any desired form. The handle portions 18 may define a maximum extent of travel of the blade assembly 14, 16 into/toward the body 12 and preferably provide a distal surface upon which a user can apply an inwardly directed force for moving the blade assemblies 14, 16 toward one another.

An opposite second end of the blades 30, 31 forms a sharp cutting edge 32, 33. The cutting edges 32, 33 are depicted in FIGS. 1-5 as being curved to follow the circumference of the aperture 20; the radius of the curvature is approximately the same as or just larger than that of the aperture 20. In another embodiment, the cutting edges 32, 33 are straight, serrated, faceted, or otherwise arranged. For example, the cutting edges may be linear and aligned at an angle relative to the direction of travel of the blades 30, 31. Or the cutting edges might be bifurcated into two linear facets arranged at angles to one another to provide a V-shaped cutting edge, among a variety of other configurations.

Upper and lower lateral edges of the blades 30, 31 include toothed portions 34U, 34L, 35U, 35L that extend along all or a portion of the respective edges. The blade assemblies 14, 16 are oppositely oriented to direct their cutting edges 32, 33 toward one another. The blades 30, 31 are offset in the axial direction of the aperture 20 so as to enable the blades 30, 31 to move toward and/or slide past one another in an overlapping relationship. The blades 30, 31 are also offset in a lateral direction perpendicular to their direction of translational movement and parallel to the plane of the blades 30, 31.

A gear train 36 is disposed within the body 12. The gear train 36 provides synchronous and symmetrical movement of the blade assemblies 14, 16, provides a bias on the blade assemblies 14, 16 toward an extended position, and enables locking of the blade assemblies 14, 16 in the collapsed position against the outward bias. Although a particular gear train 36 is described herein, it is understood that the gear train 36 may be configured in other ways to perform the same or similar function. Such other configurations are within the scope of embodiments of the invention described herein.

The gear train 36 includes a ring gear 38 disposed to circumscribe the aperture 20 and that engages an upper spur gear 40 and a lower spur gear 42. The ring gear 38 includes a plurality of gear teeth along at least a portion of the outer circumference thereof that are configured to mesh with the upper and lower spur gears 40, 42. The upper and lower spur gears 40, 42 are disposed at diametrically opposite sides of the aperture 20 and/or the body 12. A secondary upper spur gear 44 is disposed alongside and in engagement with the upper spur gear 40 and a secondary lower spur gear 46 is disposed alongside and in engagement with the lower spur gear 42. Each of the gears 40, 42, 44, 46 are of substantially the same radial dimensions and tooth pattern and provide a substantially 1:1 gear ratio. It is however, understood that other configurations can employ other gear ratios and gear configurations without departing from embodiments of the invention described herein.

The gear train 36 operates in three parallel planes that are stacked in the axial direction of the aperture 20. The ring gear 38 lies in a first plane that is nearest to the back plate 24. The upper and lower spur gears 40, 42 engage the toothed portion of the ring gear 38 in the first plane and extend from the first plane through an intermediate second plane and into a third plane.

The secondary upper spur gear 44 and the blade 30 of the first blade assembly 14 lie in the second plane. The secondary upper spur gear 44 is simultaneously enmeshed with the upper spur gear 40 and the toothed portion 34U of the blade 30 of the first blade assembly 14. The toothed portion 34U thus functions as a rack gear in a rack-and-pinion-style configuration. The toothed portion 34L on the opposite lateral edge of the blade 30 engages the lower spur gear 42 in the second plane.

The blade 31 of the second blade assembly 16 is positioned in the third plane along with the secondary lower spur gear 46. The toothed portion 35L of the blade 31 engages the secondary lower spur gear 46 while the toothed portion 35U on the opposite edge of the blade 31 engages the upper spur gear 40. The toothed portions 35L and 35U of the blade 31 thus function as rack gears in rack-and-pinion-style configurations.

The gear train 36 thus maintains synchronous movements of the blades 30, 31 relative to one another and maintains the alignment and movement of the blades 30, 31 along a diametrical path extending across the aperture 20. The blades 30, 31 are prevented from moving at different rates toward/away from one another. The upper and lower edges of each respective blade 30, 31 are also prevented from moving at different rates which would result in the blade 30, 31 becoming crocked or misaligned with the slot 26.

A coil spring 48 is disposed between the ring gear 38 and the back plate 24 within a channel 50 that generally follows the ring gear 38 along an arcuate path. The coil spring 48 is coupled at one end to a first stud (not shown) extending from the back plate 24 within the channel 50 and to a second stud 52 on the ring gear 38. The coil spring 48 thus rotationally biases the ring gear 38 in a first direction, e.g. counterclockwise as depicted in FIGS. 1-5. Hereinafter clockwise/counterclockwise rotational movement of the components of the gear train 36 are described relative to their orientation depicted in FIGS. 3 and 4.

A cam wheel 54 is coupled to an axle of the upper spur gear 40 and lies in a fourth plane. The cam wheel 54 includes a circumferential cam surface 56 that includes a stop 58 and a catch or notch 60. The stop 58 is depicted and described herein as a radially outwardly extending protuberance and the notch 60 is depicted as a radially inwardly extending depression. However the stop 58 and notch 60 can be otherwise configured but still perform the same functions as described herein. For example, the notch 60 might be configured as a radially outwardly extending bump or a protruding or depressed catch. Such other configurations are within the scope of embodiments of the invention described herein. The cam surface 56 is engaged by a pawl 62 extending from the latch lever 28. The latch lever 28 is pivotable about an axis 64 and is biased by a spring 66 toward engagement of a distal end of the pawl 62 with the cam surface 56.

A pair of spacers (a first spacer 68 and a second spacer 70) is provided within the body 12. Each of the spacers 68, 70 includes a ring portion 72, 74 and a wing portion 76, 78. The ring portion 72 of the first spacer 68 is disposed between the ring gear 38 and the blade 30 of the first blade assembly 14, e.g. between the first and second planes of the gear train 36. The ring portion 72 thus separates the blade 30 from the ring gear 38. The wing portion 76 of the first spacer 68 is configured to substantially fill a space within the slot 26 between back plate 24 and the blade 31 of the second blade assembly 16 that is not occupied by the blade 30 of the first blade assembly 14 in either the collapsed or extended positions. An edge of the wing portion 76 nearest the cutting edge 32 of the blade 30 may be contoured to match or mate with the cutting edge 32 of the blade 30 when in the collapsed position. The second spacer 70 is similarly configured and is disposed between the blade 31 of the second blade assembly 16 and the front plate 22 of the body 12. The ring portion 74 of the second spacer 70 separates the blade 31 from contact with the front plate 22. The wing portion 78 substantially fills a space within the slot 26 in the third plane of the gear train 36 that is not occupied by the blade 31 in either the collapsed or extended positions.

The spacers 68, 70 may be formed from a plastic or similar material with a low coefficient of friction so as to aid sliding motion of the blades 30, 31 therealong as well as rotational motion of the ring gear 38 which may contact the ring portion 72 of the first spacer 68.

With continued reference to FIGS. 1-5, operation of the cutter 10 is now described in accordance with an embodiment of the invention. In the collapsed position, the cutter 10 takes a torus-like form comprised of the body 12 and the handle portions 18. The blades 30, 31 extend in an overlapping relationship across and obstructing the aperture 20. In this collapsed position, the cutter 10 is easily handheld and may be placed in a pocket, carrying case, or handbag for storage or transport.

Figure 3:
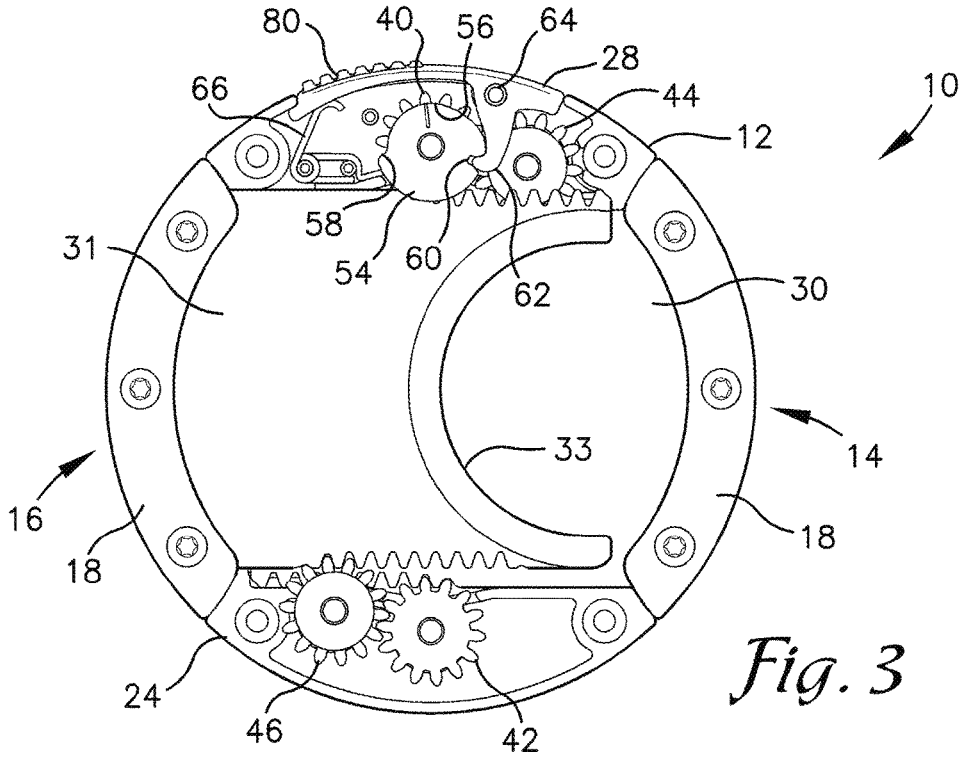
FIG. 3 is an internal view of the cigar cutter of FIG. 1 depicted with a top cover removed to show an internal gear train in accordance with an embodiment of the invention.
Figure 4:
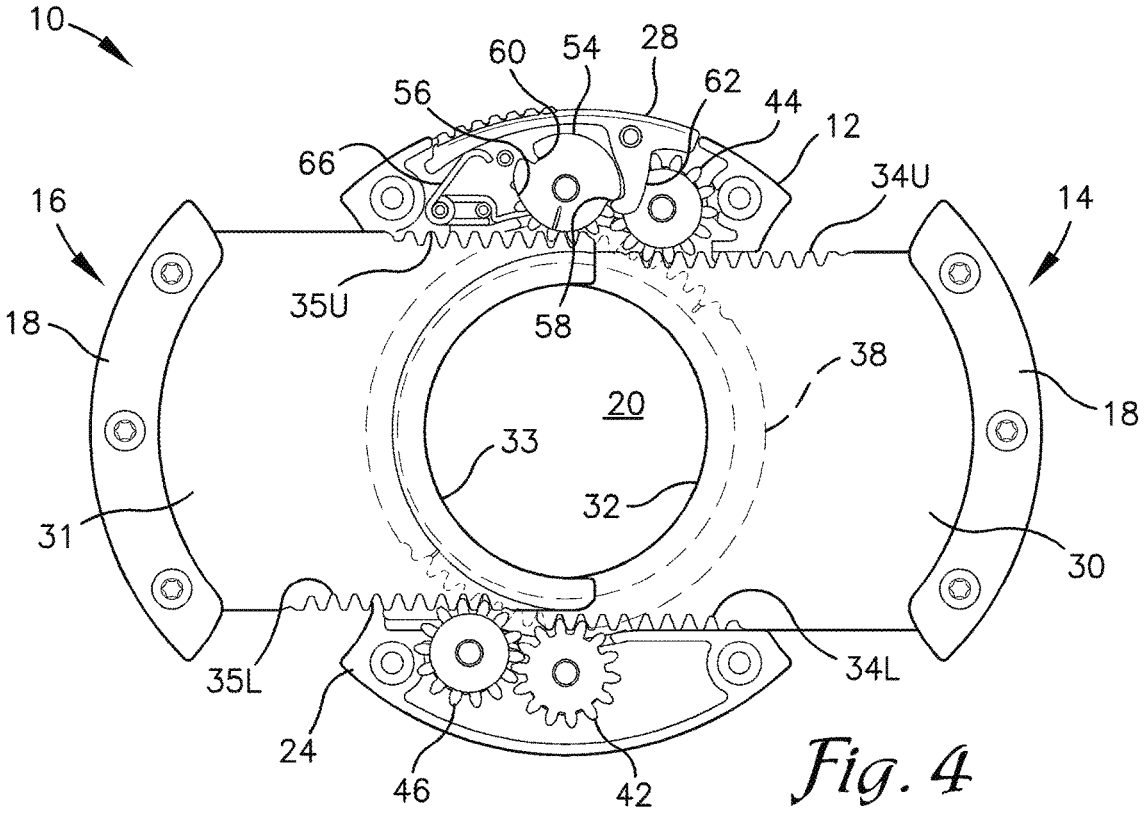
FIG. 4 is an internal view of the cigar cutter of FIG. 2 depicted with a top cover removed to show the internal gear train in accordance with an embodiment of the invention.

As shown in FIG. 3, in the collapsed position, the pawl 62 of the latch lever 28 is engaged with the notch 60 in the cam wheel 54. Pivotal bias provided by the spring 66 on the latch lever 28 maintains the engagement between the pawl 62 and the notch 60. Additionally, the coil spring 48 applies a bias on the ring gear 38 to rotate counterclockwise as depicted in FIGS. 3-4. The counterclockwise bias on the ring gear 38 further biases the gear train 36 and thus the blade assemblies 30, 31 toward the extended position. And the counterclockwise bias on the ring gear 38 also provides a clockwise bias on the cam wheel 54 which may also aid to maintain engagement of the pawl 62 with the notch 60.

Movement of the cutter 10 from the collapsed position to the extended position depicted in FIG. 4 is initiated by a user depressing a distal end 80 of the latch lever 28 thereby compressing the spring 66, pivoting the latch lever 28 counterclockwise about the axis 64, and disengaging the pawl 62 from the notch 60 in the cam wheel 54. Bias on the gear train 36 provided by the coil spring 48 rotates the cam wheel 54 in the clockwise direction to move the notch 60 away from a position in which the notch 60 is engageable by the pawl 62. Release of the latch lever 28 by the user allows the pawl 62 to move back toward the cam wheel 54 and to engage and/or ride along the cam surface 56 as the cam wheel 54 continues to rotate with the gear train 36. The rotation of the cam wheel 54 may continue until the pawl 62 contacts the stop 58 which may define a maximum travel distance of the gear train 36 and of the blade assemblies 14, 16 outwardly from the body 12. The maximum travel distance might also be defined by a length of toothed sections on the circumference of the ring gear 38 or the length of the toothed portions 34U, 34L, 35U, 35L among other features configured to limit or obstruct further rotation of the gear train 36 or travel of the blade assemblies 14, 16. The stop 58 may have a radial height sufficient to engage the pawl 62 when the latch lever 28 is depressed or released such that the gear train 36 cannot exceed the maximum travel distance when the user maintains the latch lever 28 in the depressed position.

The gear train 36 operates to provide synchronous and symmetrical movement of the blade assemblies 14, 16 between the collapsed and extended positions. After release of the cam wheel 54 from the pawl 62, the coil spring 48 operates to rotate the ring gear 38 counterclockwise. This acts to rotate the upper spur gear 40 and the lower spur gear 42 in the clockwise direction.

The upper spur gear 40 is engaged with the secondary upper spur gear 44 and the upper toothed portion 35U of the blade 31 of the second blade assembly 16. The secondary upper spur gear 44 is thus rotated counterclockwise. The second blade assembly 16 is moved outwardly away from the aperture 20.

The secondary upper spur gear 44 is further engaged with the upper toothed portion 34U of the blade 30 of the first blade assembly 14. The first blade assembly 14 is thus moved outwardly away from the aperture 20 in a direction opposite that of the second blade assembly 16.

Similarly, the lower spur gear 42 is engaged with the secondary lower spur gear 46 and with the lower toothed portion 34L of the blade 30 of the first blade assembly 14. The secondary lower spur gear 46 is thus rotated counterclockwise and the first blade assembly 14 is moved outwardly away from the aperture 20.

The secondary lower spur gear 46 is further engaged with the lower toothed portion 35L of the blade 31 of the second blade assembly 16. The second blade assembly 16 is thus moved outwardly away from the aperture 20.

The blade 30 of the first blade assembly 14 is thus driven outwardly by engagement with both the lower spur gear 42 and the secondary upper spur gear 44. The blade 31 of the second blade assembly 16 is driven outwardly by engagement with both the upper spur gear 40 and the secondary lower spur gear 46. As such, the blades 30, 31 are supported along each edge by respective spur gears 40, 42, 44, 46 and are driven at equal rates relative to one another. The upper and lower edges of the blades 30, 31 are also driven or guided at equal rates which prevents the blades 30, 31 from becoming misaligned or crooked within the slot 26.

The blades 30, 31 are moved outwardly away from the aperture 20 a distance sufficient to place their respective cutting edges 32, 33 flush with or sub-flush with the perimeter of the aperture 20. As such, the risk of a user cutting themselves on the cutting edges 32, 33 while the cutter 10 is in the extended position is reduced or eliminated.

In the extended position, the cap end of a cigar, or a portion of another product to be cut, can be inserted at least partially into the aperture 20 and through the second and third planes occupied by the blades 30, 31. To cut the cigar, an inwardly directed force is applied to one or both of the handle portions 18 of the first and second blade assemblies 14, 16. It is preferable to apply an equal force on each of the first and second blade assemblies 14, 16 but such is not required; the configuration of the gear train 36 distributes the forces (equal or unequal) applied on the blade assemblies 14, 16, to move the blades 30, 31 at equal rates and with equal cutting force.

Application of the inwardly directed force on the blade assemblies 14, 16 moves the cutting edges 32, 33 toward one another to cut into and through the cigar from opposite sides thereof in a guillotine fashion. The synchronous and symmetrical movement of the blades 30, 31 provides self-centering of the cigar within the aperture 20 which may aid to ensure an even and clean cut. The rounded shape of the cutting edges 32, 33 may also aid center the cigar within the aperture 20 and to evenly apply the cutting force around the circumference of the cigar. Even application of the cutting forces may provide a cleaner cut without deforming the shape of the cigar.

Movement of the blade assemblies 14, 16 inward toward the aperture 20 operates to move the gear train 36 in the opposite direction to that described above and thus rotates the cam wheel 54 in the opposite direction (e.g. clockwise). Upon realignment of the pawl 62 with the notch 60, the spring 66 biases the pawl 62 into engagement with the notch 60 to again retain the cutter 10 in the collapsed position.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Identification of structures as being configured to perform a particular function in this disclosure and in the claims below is intended to be inclusive of structures and arrangements or designs thereof that are within the scope of this disclosure and readily identifiable by one of skill in the art and that can perform the particular function in a similar way. Certain features and sub-combinations are of utility and may be employed without reference to other features and sub-combinations and are contemplated within the scope of the claims.

What is claimed is:

1. A cigar cutting device comprising:

a planar body forming an aperture and a slot extending through the body, the aperture extending in a direction perpendicular to the planar body, and the slot extending in a direction parallel to the planar body and intersecting the aperture, the aperture having dimensions sufficient to receive an end of a cigar at least partially therein;

a first cutting blade disposed in the slot from a first edge of the body and translationally moveable within the slot to at least partially obstruct the aperture;

a second cutting blade disposed in the slot from a second edge of the body and translationally moveable within the slot to at least partially obstruct the aperture, the second edge being opposite the first edge, and the second cutting blade moveable to at least partially overlap the first cutting blade within the aperture; and a ring gear disposed within the body and circumscribing the aperture, the ring gear being operably engaged with the first and second cutting blades and causing synchronous translational movements of the first and second cutting blades.

2. The cigar cutting device of claim 1, further comprising:

a first gear disposed within the body and operably engaged with the ring gear and with a first lateral edge of the second cutting blade; and a second gear disposed within the body and operably engaged with the ring gear and with a first lateral edge of the first cutting blade.

3. The cigar cutting device of claim 2, further comprising:

a first intermediate gear operably engaged with the first gear and with a second lateral edge of the first cutting blade; and a second intermediate gear operably engaged with the second gear and with a second lateral edge of the second cutting blade.

4. The cigar cutting device of claim 1, wherein the first and second blades each include a first and a second lateral edge, and wherein the first and second lateral edges include a plurality of gear teeth extending along at least a portion of the length of the respective lateral edges.

5. The cigar cutting device of claim 1, further comprising:

a spring providing a rotational bias on the ring gear.

6. The cigar cutting device of claim 5, wherein the spring extends along an arcuate path of the same radial dimensions as the ring gear.

7. The cigar cutting device of claim 6, wherein the body includes a channel formed in an interior wall thereof, and wherein the spring is disposed in the channel.

8. The cigar cutting device of claim 1, further comprising:

a cam wheel operatively coupled to the ring gear, the cam wheel including a circumferential cam surface and a catch on the cam surface; and a latch lever with a pawl extending therefrom, the latch lever being pivotable about an axis to engage the pawl with the catch on the cam wheel, engagement of the pawl with the catch retaining the first and second cutting blades in a collapsed position in which the first and second cutting blades at least partially overlap within the aperture.

9. The cigar cutting device of claim 8, wherein the cam wheel includes a stop at an end of the cam surface opposite the catch, and wherein the catch defines a maximum translational travel distance of the first and second cutting blades in a direction away from one another.

10. The cigar cutting device of claim 1, wherein the body forms at least a portion of a ring torus-shaped three-dimensional form.

11. The cigar cutting device of claim 1, wherein the first and the second blades are moveable between a collapsed position and an extended position and the first and second blades are biased toward the extended position, in the collapsed position the first and second blades at least partially overlap within and obstruct at least a portion of the aperture, and in the extended position the first and second blades do not extend into the aperture.

12. A cigar cutting device comprising:

a body having major dimensions extending within a single plane and forming an aperture that extends perpendicular to the plane and a slot extending through the body parallel to the plane and intersecting the aperture, the aperture having dimensions sufficient to receive an end of a cigar at least partially therein;

a first cutting blade and a second cutting blade disposed in the slot from opposite edges thereof and being translationally moveable within the slot; and a ring gear disposed within the body and circumscribing the aperture, the ring gear being operably engaged with the first and second cutting blades to simultaneously and equally move the first and second cutting blades in opposite directions within the slot between a collapsed position in which the first blade at least partially overlaps the second blade within the aperture and an extended position in which the first and second blades are not within the aperture.

13. The cigar cutting device of claim 12, wherein the ring gear is biased toward rotation in a first direction, and wherein rotation of the ring gear in the first direction moves the first and second cutting blades toward the extended position.

14. The cigar cutting device of claim 13, further comprising:

a latch lever that is operably engaged with the ring gear to retain the ring gear against rotation in the first direction and to retain the first and second cutting blades in the collapsed position.

15. The cigar cutting device of claim 14, further comprising:

a gear train disposed within the body and operably coupling the ring gear with the first and second cutting blades; and a cam wheel coupled to the gear train, the latch lever engaging a catch on the cam wheel to prevent operation of the gear train and to retain the ring gear against rotation in the first direction.

16. A cigar cutting device comprising:

a ring-shaped body having a pair of cutouts along diametrically opposing edges thereof and an aperture sized to receive at least a portion of a cigar therein;

a diametrically arranged slot extending between the cutouts and intersecting the aperture;

a first and a second cutting blade disposed in the slot in opposing directions with cutting edges thereof being directed toward one another, the first and the second cutting blades being translationally moveable within the slot to at least partially overlap the first cutting blade with the second cutting blade, each of the first and the second cutting blades including a plurality of gear teeth disposed along at least a portion of two opposing lateral edges thereof, the gear teeth being operably engaged with the gear train in a rack-and-pinion style configuration; and a gear train disposed within the body and operably coupled with the first and the second cutting blades, the gear train providing synchronous movements of the first and the second cutting blades in opposite directions.

17. The cigar cutting device of claim 16, wherein the gear train includes a ring gear disposed within the body and circumscribing the aperture, the ring gear being operably coupled to the first and the second cutting blades and causing translational movement of the first and the second cutting blades within the slot.

18. The cigar cutting device of claim 16, wherein the gear train includes a plurality of spur gears that engage the gear teeth on the lateral edges of the first and the second cutting blades to move the first and the second cutting blades within the slot.

19. The cigar cutting device of claim 16, further comprising:

a pair of handle portions, each handle portion coupled to a respective one of the first and the second cutting blades at an end opposite the cutting edge, each handle portion configured to be received within a respective one of the cutouts.

* * * * *